US005897011A

United States Patent [19]

Brilliant et al.

[11] Patent Number: 5,897,011

[45] Date of Patent: Apr. 27, 1999

[54] CLAMSHELL CONTAINER WITH TEAR-AWAY LID

[75] Inventors: William L. Brilliant, Stoughton; Donald E. McCumber, Madison, both of Wis.

[73] Assignee: Anchor Packaging, Inc., Fenton, Mo.

[21] Appl. No.: 08/914,276

[22] Filed: Aug. 19, 1997

[51] Int. Cl.[6] ..... B65D 6/28; B65D 41/32

[52] U.S. Cl. ..... 220/4.23; 220/4.25; 220/266

[58] Field of Search ..... 220/4.23, 4.25, 220/339, 266

[56] References Cited

U.S. PATENT DOCUMENTS

| | | | |
|---|---|---|---|
| 3,937,389 | 2/1976 | Wind | 220/339 |
| 4,189,054 | 2/1980 | Liu et al. | 220/4.23 |
| 4,244,470 | 1/1981 | Burnham | 220/4.23 |
| 4,298,133 | 11/1981 | Davis | 220/4.23 |
| 4,360,106 | 11/1982 | Irvine et al. | 206/621 |
| 4,917,261 | 4/1990 | Borst | 220/324 |
| 4,962,849 | 10/1990 | Anderson | 206/45.24 |
| 4,986,438 | 1/1991 | Borst | 220/315 |
| 5,012,928 | 5/1991 | Proffitt et al. | 206/508 |
| 5,046,659 | 9/1991 | Warburton | 220/339 |
| 5,092,479 | 3/1992 | Wells | 220/4.23 |
| 5,269,430 | 12/1993 | Schlaupitz et al. | 220/4.23 |
| 5,429,833 | 7/1995 | Wyslotsky | 426/122 |

FOREIGN PATENT DOCUMENTS

| | | | |
|---|---|---|---|
| 4-44962 | 2/1992 | Japan | B65D 43/06 |

*Primary Examiner*—Paul T. Sewell
*Assistant Examiner*—J. Mohandesi
*Attorney, Agent, or Firm*—Armstrong Teasdale LLP

[57] ABSTRACT

A clamshell container for food is formed of a single sheet of thermoplastic material thermoformed to have a concave base with an upwardly extending sidewall with an outwardly extending peripheral flange. A hinge attachment segment extends outwardly from the base flange, and a lid is connected to the hinge attachment segment along an integral hinge which allows pivoting of the lid to cover and uncover the base. Intermittent perforations in the plastic define a line of weakened material between the base flange and the hinge attachment segment. A tab extends from the hinge attachment segment. Pulling on the tab causes the hinge attachment segment to separate from the base flange along the line of weakened material, to thereby remove the lid from the base, leaving a dining dish which has insubstantial indications of its former connection to a lid, thereby better simulating conventional dinnerware. The hinge is preferably formed with stiffening hinge walls which, while not interfering with the hinging of the lid over the base, contribute to the stiffness of the hinge when it is torn from the base.

19 Claims, 3 Drawing Sheets

CLAMSHELL CONTAINER WITH TEAR-AWAY LID

FIELD OF THE INVENTION

The present invention relates to plastic containers in general, and to clamshell containers in particular.

BACKGROUND OF THE INVENTION

The pressing demands of work and family commitments in a modem economy often encroach upon time traditionally set aside for meal preparation. Exacting business and recreational activities can make it difficult to assemble a nutritious and satisfying dining experience while still fulfilling commercial and social obligations. One alternative to preparing a meal at home is to dine out at a restaurant. Yet restaurant dining is not always an acceptable substitute for eating at home. Aside from the costs for food and tips, dining out requires all members of the family to travel outside the home. Furthermore, many restaurants require levels of dress and deportment which may not be suited for a particular family situation.

Carry-out restaurants provide the alternative of restaurant food in a home environment. Yet typically the food packaging of the carry-out restaurant is distinctively disposable and conveys an ambiance distinctly at odds with the home dining experience. Supermarkets and speciality take-out restaurants are appealing to the home meal replacement market by providing prepared entrees for eating at home. What is needed is a food container which is economical and conveniently filled by the preparer of the meal, yet which is attractive and not out of place in a home setting.

SUMMARY OF THE INVENTION

A clamshell container of this invention provides a container for food which retains the container lid in connection with the container base in an unfilled configuration, and which is conveniently stored and shipped prior to use as a single stock-keeping unit. The container is formed of a single sheet of thermoplastic material which is molded in the thermoforming process such that the base is concave with an upwardly extending sidewall with an outwardly extending peripheral flange. A hinge attachment segment extends outwardly from the base flange, and the lid is connected to the hinge attachment segment along an integral hinge which allows pivoting of the lid to cover and uncover the base. Intermittent perforations in the plastic define a line of weakened material between the base flange and the hinge attachment segment. The lid is separable from the base by pulling on a tab which extends from the hinge attachment segment. The hinge attachment segment and the lid part from the base along the line of weakened material leaving a dining dish which has insubstantial indications of its former connection to a lid, thereby better simulating conventional dinnerware. The hinge is preferably formed with stiffening hinge walls which, while not interfering with the hinging of the lid over the base, contribute to the stiffness of the hinge when it is torn from the base. Although the hinge has parallel extending walls, the line of weakened material will preferably follow the outwardly facing periphery of the base flange which, for a curved dish, will be curved.

It is an object of the present invention to provide a container with a lid which is easily separated from its base without tools.

It is another object of the present invention to provide a container with a lid which may be removed from the base to leave minimal evidence of its former connection thereto.

It is also an object of the present invention to provide a clamshell thermoformed plastic container which may be easily reconfigured to simulate a dining dish.

It is an additional object of the present invention to provide a clamshell container with a lid that separates from the base at a location spaced from the hinge.

Further objects, features and advantages of the invention will be apparent from the following detailed description when taken in conjunction with the accompanying drawings.

DESCRIPTION OF THE PREFERRED EMBODIMENT

Figure 1:
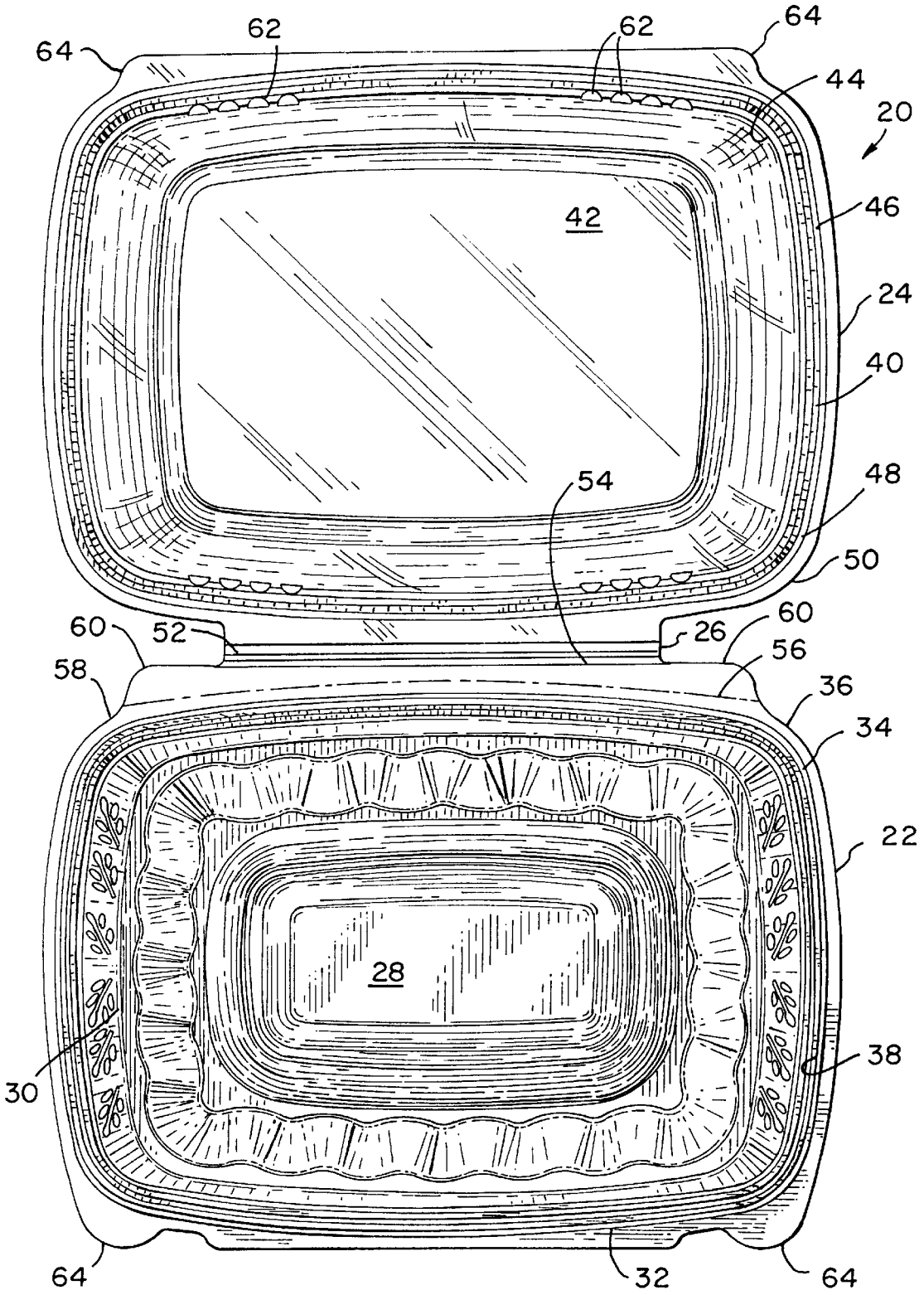
FIG. 1 is a top plan view of a container of this invention.
Figure 2:
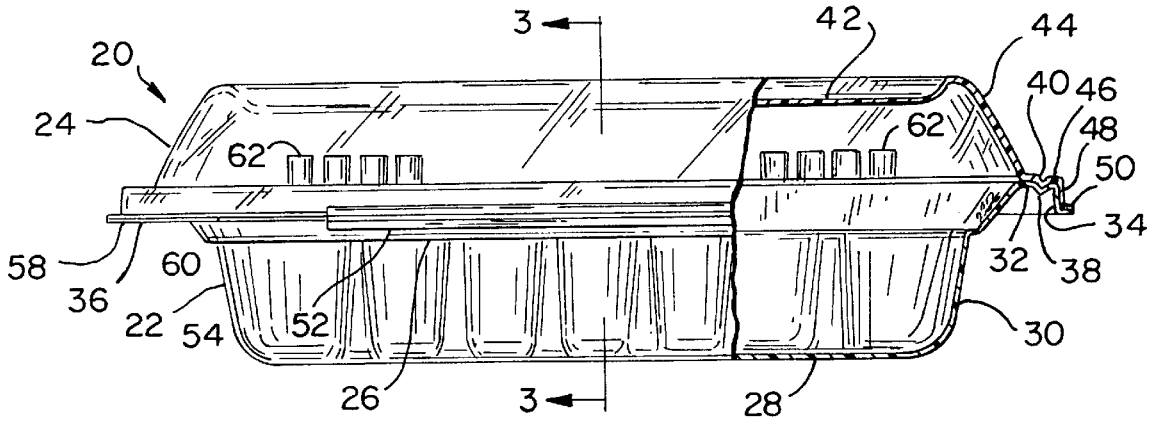
FIG. 2 is a rear elevational view, partially broken away in section, of the package of FIG. 1.
Figure 3:
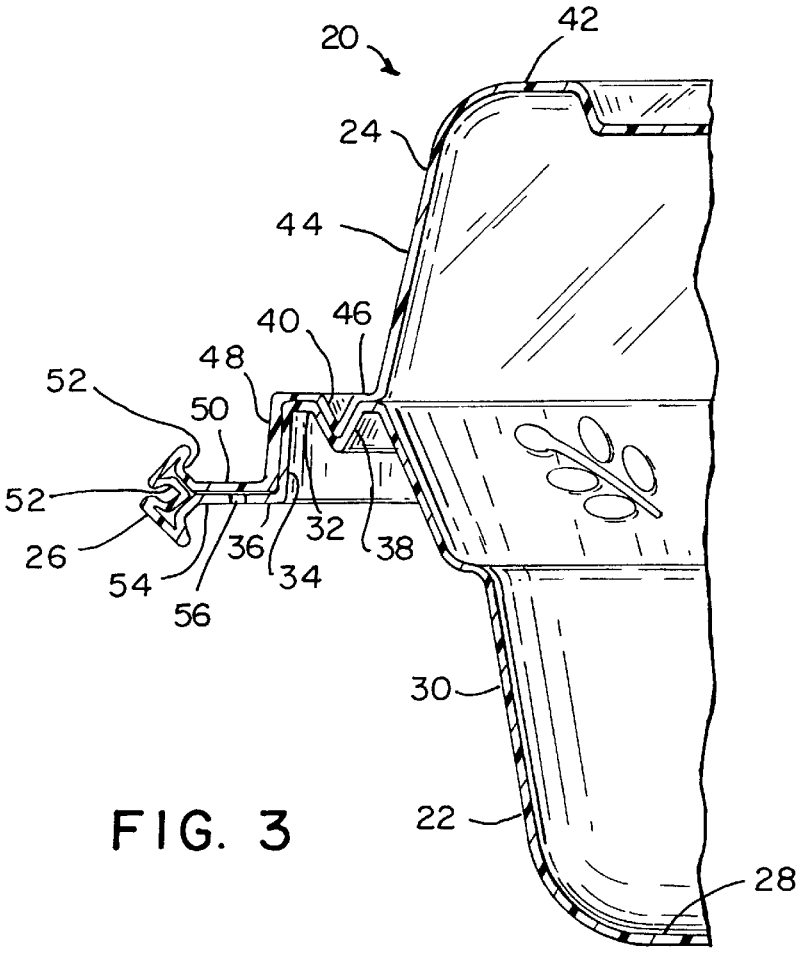
FIG. 3 is an enlarged fragmentary cross-sectional view of the package of FIG. 2 taken along section line 3—3.
Figure 4:
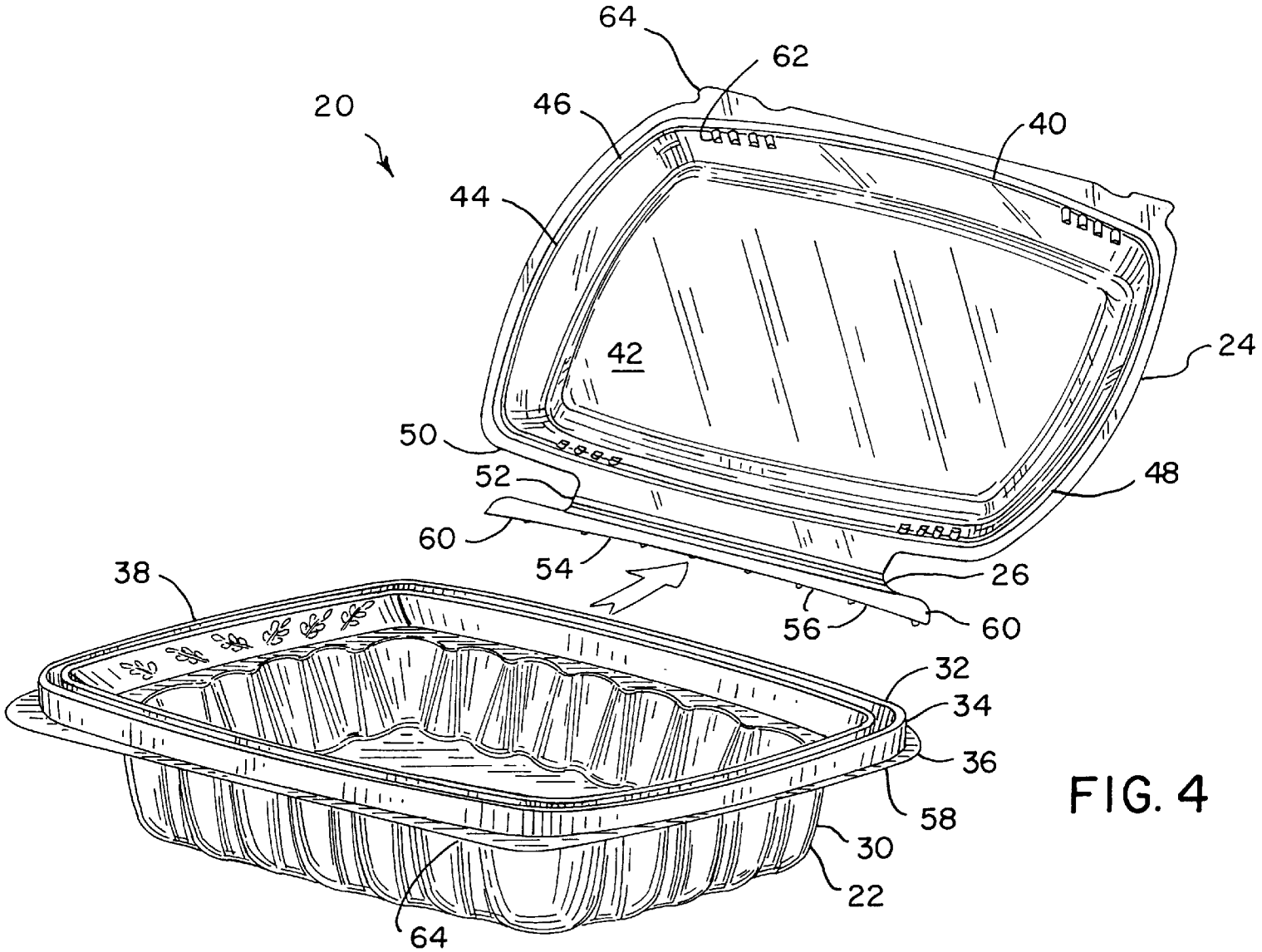
FIG. 4 is an exploded isometric view of the package of FIG. 1 showing the container lid removed along a tear-away line of perforations from the container base.

Referring more particularly to FIGS. 1–4 wherein like numbers refer to similar parts, a thermoformed thermoplastic clamshell container 20 is shown in FIGS. 1–3. The container 20 is molded from a single sheet of thermoplastic material to have a base 22 with a lid 24 which is connected to the base and which pivots about a hinge 26 between a position which covers the base and one which uncovers the base. The sheet of thermoplastic material from which the container is formed is preferably coextruded of transparent d o lastics to have generally transparent material in the regions defining the lid 24, with generally opaque material in the regions defining the base 22.

As best shown in FIG. 2, the base 22 has a bottom wall 28 from which a sidewall 30 extends upwardly, terminating in an outwardly extending peripheral lip 32. A skirt 34 extends downwardly from the lip 32, and a generally horizontal peripheral flange 36 extends outwardly from the skirt. For reasons of ornamentation, stiffness, and mold release, the general outline of the base 22 and the base sidewall 30 will generally be other than strictly rectangular, usually a closed curved shape of some sort. The base flange 36 extends outwardly from the skirt a uniform amount for the majority of the periphery as it extends around the base 22.

Because the base 22 may be called upon to contain liquids or vapors, the base peripheral lip 38 is preferably formed with a downwardly depending groove 38 therein. The base groove 32 receives a protrusion 40 which extends downwardly form the lid 24 when the lid is closed on the base. When the protrusion 40 is engaged within the groove 38 a type of labyrinthine baffle is formed which restricts the escape of liquids and vapors from the closed container 20.

The lid 24 has a top wall 42 with a downwardly extending sidewall 44. A lip 46 extends outwardly form the sidewall, and the protrusion 40 extends downwardly from the lip. A skirt 48 extends downwardly from the lip 46, and a lid flange 50 extends outwardly from the skirt 48. The lid skirt 48 and the base skirt 34 may be formed with an encircling undercut ridge where the skirts adjoin the lid and base flanges, such that when the lid is pressed down on the base it is retained in the closed position in a snap fit.

As shown in FIG. 1, the lid flange 50 encircles the lid, and is generally evenly spaced from the lid sidewall 44. At the rear of the lid 24, however, the flange 50 extends to the hinge 26. The hinge 26 is a W-type hinge, having four generally parallel hinge walls 52, which, in the lid open position as shown in FIG. 1, extend generally vertically with respect to the base flange 36. The W-type hinge 26 provides a durable hinge with six parallel axes of flexure, which are each subjected to less bending than would a single hinge axis. The multiple hinge walls 52 also contribute to the stiffness of the hinge against bending about an axis perpendicular to the hinging axes.

While the hinge 26 is securely and intimately connected to the lid 24 along the lid side of the hinge, along the base side of the hinge a planar flap of material defines a hinge attachment segment 54 which extends to the base flange 36. The hinge attachment segment 54 is connected to the base flange 36 along a plurality of aligned perforations 56 which define a line of weakened material in the plastic. The perforations 56 may be formed in the plastic part 20 by any conventional method, for example by matched mold dies. To leave a minimal amount of residue on the base from the lid, it is preferred that the length of the cut portions of the perforations be greater than the length of the attached and uncut portions of the connection between the hinge attachment segment and the base. For example, uncut portions of about 1/16 of an inch may be positioned between cut portions of approximately ½ inch in length. Because of the curved geometry of the base and the curved outer periphery 58 of the base flange 36, it will be noted that the line of weakened material will often not be parallel to the hinge 26.

Tabs 60 extend from the hinge attachment segment, with the line of perforations extending between the two tabs. Each tab 60 provides an alternative location for a user to grasp the hinge attachment segment and lid and to apply force to separate the lid from the base. Furthermore, the tabs may be marked with instructional indicia, such as words or icons. For example, the words "PULL" or "OPEN" may be molded into the tabs, or labels bearing an instruction may be placed on the tabs.

The container 20 offers the purveyor of prepared foods a convenient package in which the base and the lid are connected together for ready assembly, and which is nestable for compact storage. Denesting lugs 62 may project from the lid to aid in separation of the nested unfilled containers 20. Typically the container 20 will be filled by the merchant and the lid closed on the base to retain the food therein. The consumer purchases one or more filled containers and returns home. If the contents require reheating the lids may be loosened on the base and heat applied. If consumption of the meal is to be delayed, the closed containers may be placed in the refrigerator or freezer until mealtime. Once the food is at the desired temperature and the meal is ready to be served, the container lid has fulfilled its function and is no longer of any use. The weakened line of material between the hinge attachment segment and the and base flange allows the lid to be easily removed from the base for recycling or other disposal.

The container may be opened by applying opposing finger pressure to overlapping release tabs 64 which extend from the lid and the base on the front of the package, as best shown in FIG. 1. The opened lid is then pivoted about the hinge. The user may clasp the lid or the hinge attachment segment itself by a tab, and then apply force to displace the hinge attachment segment from the base flange. The tiny regions of plastic connection between the perforations will yield in response to this force, and the lid will cleanly come away from the base. With the lid removed the base stands alone as an attractive dining dish. All that remains to indicate that a cover was ever attached to the base are the tiny nubs of plastic between the perforations. The base, when placed on the dining table before a consumer presents the appearance of tableware, and is hence better suited to a dining experience which more closely approximates a home prepared meal.

It should be noted that the containers of this invention may be molded in a multitude of shapes and dimensions to accommodate a variety of food contents. For example the overall shape may be circular, oval, generally rectangular, rectangular, square, or even divided into multiple internal compartments for containing collections of diverse food items.

The container may be formed of any conventional thermoplastic material depending on the specific package need. For example, higher temperature resistant plastic materials may be called for in the base where hot foods are to be contained, while other materials may be used where only cool foods are to be contained.

It is understood that the invention is not limited to the particular construction and arrangement of parts herein illustrated and described, but embraces such modified forms thereof as come within the scope of the following claims.

We claim:

1. A thermoplastic thermoformed container comprising:

a base having a bottom wall with an upwardly extending sidewall and a flange which extends around the sidewall and extends outwardly therefrom;

a lid which is positionable to overlie and cover the base;

a hinge integrally formed with the lid, wherein the lid is pivotable about the hinge; and a hinge attachment segment which extends from the hinge to the base flange, the hinge attachment segment being connected to the base flange along a line of weakened material which is positioned between the hinge and the base, such that the lid is separable from the base by tearing along the line of weakened material.

2. The container of claim 1 further comprising a first separation tab which extends outwardly from the hinge attachment segment to provide a graspable region for finger engagement of the hinge attachment segment and forcible removal of the lid from the base.

3. The container of claim 2 further comprising instructional indicia positioned on the first separation tab to instruct a user on how to separate the lid from the base.

4. The container of claim 2 wherein a second separation tab extends from the hinge attachment segment at a location spaced from the first separation tab, the line of weakened material extending between the first separation tab and the second separation tab.

5. The container of claim 1 wherein the line of weakened material comprises a plurality of perforations formed in the plastic of the container between the base flange and the hinge attachment segment.

6. The container of claim 1 wherein the flange has an outwardly facing periphery which extends around the base, and wherein the flange outwardly facing periphery is curved where it engages the hinge attachment segment along the line of weakened material, such that the line of weakened material defines a curved line which is not parallel to the hinge.

7. The container of claim 1 wherein a peripheral lip extends outwardly from the base sidewall, and wherein a skirt extends downwardly from the base lip and the base flange extends outwardly from the skirt at a level below the peripheral lip.

8. The container of claim 1 wherein the base and the lid are formed from a single sheet of thermoformed thermoplastic material.

9. The container of claim 1 wherein the hinge comprises a plurality of hinge walls extending approximately vertically from the plane of the base flange, the hinge walls thereby contributing to the stiffening of the hinge about an axis which is approximately parallel to an axis about which the hinge pivots, said stiffening facilitating the removal of the hinge and attached hinge segment from the base flange.

10. The container of claim 1 wherein the lid has a downwardly extending sidewall, and further comprising:

a base lip which extends outwardly from the base sidewall;

portions of the base lip which define a groove;

a lid lip which extends outwardly from the lid sidewall; and portions of the lid lip which define a protrusion which extends into the groove when the lid is closed on the base.

11. A thermoformed thermoplastic container for food comprising a single sheet of thermoplastic material molded to comprise:

a concave base having an upwardly extending sidewall with a peripheral flange which extends outwardly therefrom;

a lid which is positionable over the concave base to cover the base;

a hinge which extends from the lid to the base, the lid being pivotable about the hinge to alternately cover and uncover the base;

a hinge attachment segment which extends from the hinge to the base flange; and portions of the base flange which define a plurality of perforations extending along the hinge attachment segment, the perforations defining a line of weakened plastic material which is spaced from the hinge and positioned between the hinge and the base sidewall, the hinge attachment segment and the lid being separable from the lid by displacing the hinge attachment segment with respect to the flange along the line of weakened plastic material.

12. The container of claim 11 further comprising a first separation tab which extends outwardly from the hinge attachment segment to provide a graspable region for finger engagement of the hinge attachment segment and forcible removal of the lid from the base.

13. The container of claim 12 further comprising instructional indicia positioned on the first separation tab to instruct a user on how to separate the lid from the base.

14. The container of claim 12 wherein a second separation tab extends from the hinge attachment segment at a location spaced from the first separation tab, the line of weakened material extending between the first separation tab and the second separation tab.

15. The container of claim 11 wherein the flange has an outwardly facing periphery which extends around the base, and wherein the flange outwardly facing periphery is curved where it engages the hinge attachment segment along the line of weakened material, such that the line of weakened material defines a curved line which is not parallel to the hinge.

16. The container of claim 11 wherein a peripheral lip extends outwardly from the base lip, and wherein a skirt extends downwardly from the base sidewall and the base flange extends outwardly from the skirt at a level below the peripheral lip.

17. The container of claim 11 wherein the hinge comprises a plurality of hinge walls extending approximately vertically from the plane of the base flange, the hinge walls thereby contributing to the stiffening of the hinge about an axis which is approximately parallel to an axis about which the hinge pivots, said stiffening facilitating the removal of the hinge and attached hinge segment from the base flange.

18. The container of claim 11 wherein the lid has a downwardly extending sidewall, and further comprising:

a base lip which extends outwardly from the base sidewall;

portions of the base lip which define a groove;

a lid lip which extends outwardly from the lid sidewall; and portions of the lid lip which define a protrusion which extends into the seal when the lid is closed on the base.

19. A method for deploying a food containing concave dish for dining therefrom, comprising the steps of:

pivoting the lid of a thermoformed thermoplastic clamshell container out of engagement with the base of the container by rotating the lid about a hinge which is integrally formed with the lid, the hinge being connected to the base by a hinge attachment segment which extends from a base outwardly extending flange along a line of weakened plastic material;

engaging a portion of the hinge attachment segment and displacing the hinge attachment segment from the base flange along the line of weakened material which is positioned between the hinge and the base to separate the hinge attachment segment and the attached lid from the base to thereby create a concave dish with no lid attached thereto; and positioning the concave dish on a support surface for dining therefrom.

* * * * *